United States Patent [19]

Bodendorfer

[11] 3,944,240

[45] Mar. 16, 1976

[54] SKI BINDING

[76] Inventor: Roland Bodendorfer, 25 Erdenweg, A-1140 Vienna, Austria

[22] Filed: June 10, 1975

[21] Appl. No.: 585,570

[30] Foreign Application Priority Data

July 19, 1974 Austria ..... 5966/74
Feb. 28, 1975 Austria ..... 1578/75

[52] U.S. Cl. ..... 280/11.35 T
[51] Int. Cl.[2] ..... A63C 9/08
[58] Field of Search ..... 280/11.35 T, 11.35 K

[56] References Cited

UNITED STATES PATENTS

| | | | |
|---|---|---|---|
| 3,578,349 | 5/1969 | Edmund | 280/11.35 K |
| 3,606,370 | 9/1971 | Spademan | 280/11.35 T |
| 3,887,205 | 6/1975 | Edmund | 280/11.35 C |
| 3,888,495 | 6/1975 | Zahradka | 280/11.35 T |

*Primary Examiner*—Robert R. Song
*Attorney, Agent, or Firm*—Imirie, Smiley & Linn

[57] ABSTRACT

A safety ski binding comprises a footplate and a tie rod which is mounted on said footplate and is adapted to be displaceable against spring force in the axis of symmetry of the footplate. This axis of symmetry extends in the longitudinal direction of the ski when the binding is in position for a downhill run. Said tie rod is adapted to be held in position by a tightener. Two pairs of rollers are carried by the tie rod and the footplate, respectively. The axles of said rollers extend transversely to the longitudinal axis of the tie rod and parallel to the plate and are secured to the tie rod and the plate, respectively. Said tie rod has a portion which extends within a guide and is provided adjacent to the tightener with an upwardly directed release nose. The boot which is associated with the binding is provided at the forward and near edges of its heel with bearing surfaces for the rollers and is provided preferably in the tread face of the heel with a groove which receives the guide when the binding is in position for a downhill run. Said footplate is pivotally movable about a pivot which is mounted on the baseplate.

7 Claims, 8 Drawing Figures

SKI BINDING

SUMMARY OF THE INVENTION

Figure 1:
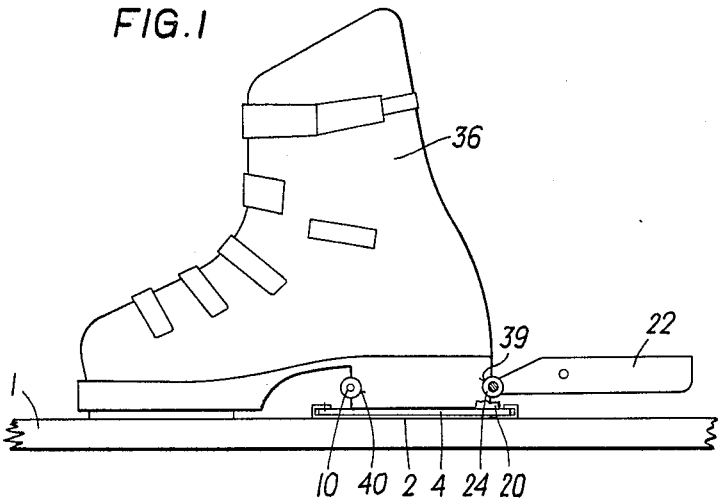

A ski binding comprises a footplate which at its forward end is mounted on vertical pin to be pivotally movable at right angles to the skiing direction. The pin is carried by a baseplate secured to the ski. The heel of the boot is held by two pairs of rollers. One of said pairs engages the rear edge of the heel and is rotatably mounted on a stationary axle, which extends transversely to the skiing direction. The other pair of rollers engages the forward edge of the heel of the boot and is rotatably mounted on an axle which extends transversely to the skiing direction and which is carried by a rod that is mounted on the footplate and extends in the skiing direction. Said rod has a surface which is engageable by a roller, which releases a spring-loaded tightener in response to an overloading of the ski in the skiing direction. The footplate has surfaces for guiding a roller carried by said rod so that said tightener is released in response to a rotational movement performed by said footplate under an excessive transverse load on the ski binding.

BACKGROUND OF THE INVENTION

Safety bindings are known which engage the boot only adjacent to its heel, as well as safety bindings which can be imagined to be transferred toward said heel. Most of these bindings engage lateral hardware or extend into openings from below. The protruding hardware can easily be damaged. Modern skiing techniques involve also the danger that such hardware is caught by the other boot or by stones. Openings extending from below cannot be kept clean in such an arrangement. Bindings are known which are tightened in the longitudinal direction of the ski. These bindings comprise plates which may have various forms and are screw-connected to the sole of the boot and engaged with binding elements which serve to transmit force, to control the ski, and to release the binding. This has the disadvantage that only a small space is available so that the contact surfaces are small and the pressure per unit of area is high, particularly as the required holding forces increase as the distance between the gripping surfaces decreases in relation to the length of the ski. Stronger forces and a higher pressure per unit of area involve stronger and heavier gripping elements, which must not have inserts of plastics material and are susceptible to damage and may become impressed into the plates. The function of these bindings is adversely affected soon and they cannot be reset.

It is an object of the invention to provide a safety ski binding which may be used in conjunction with a conventional boot comprising a heel, sole, and shank. Experience has shown that best results can be obtained with such boots. It is another object of the invention to provide a ski binding which can hold and release the heel of the skiing boot independently of the state of maintenance of the binding and in which the forces required for a release vary in a constant range which is independent of the adjustable force which tends to restore the binding when the ski has been subjected to a transverse impact. An additional object of the invention is to provide a ski binding which is structurally simple and may be provided with robust components which can be made in part of plastics material so that they are light in weight.

Figure 3:
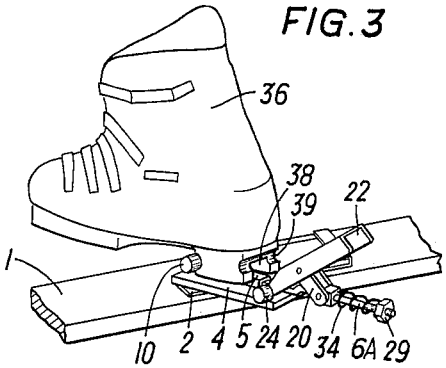
Figure 2:
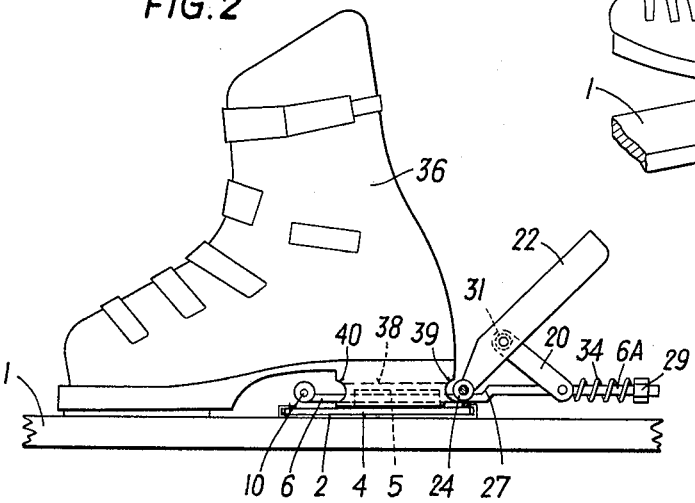
Figure 4:
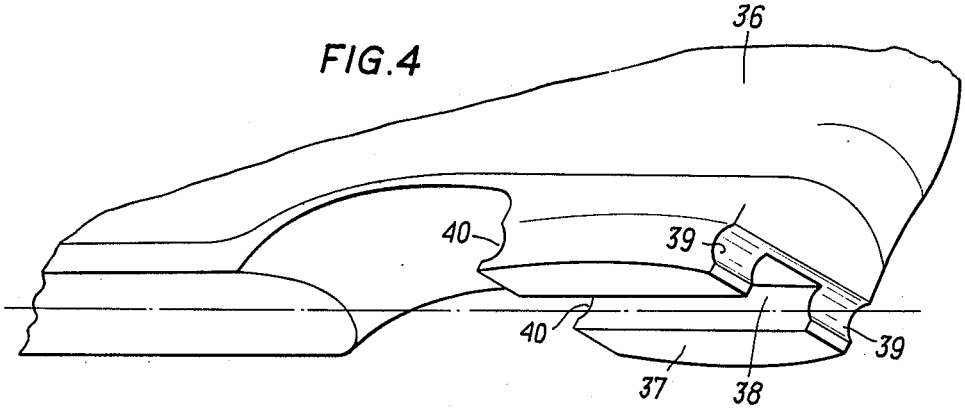
Figure 5:
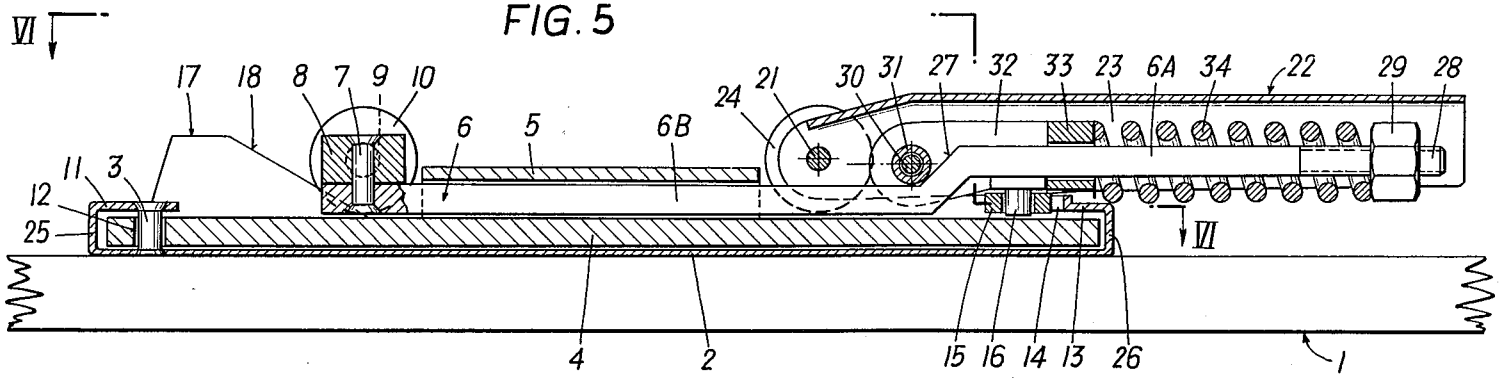
Figure 6:
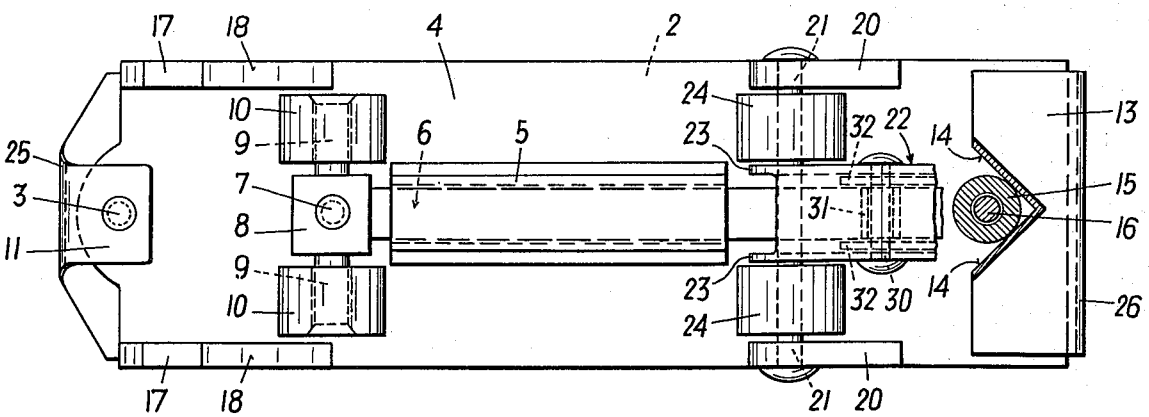
Figure 7:
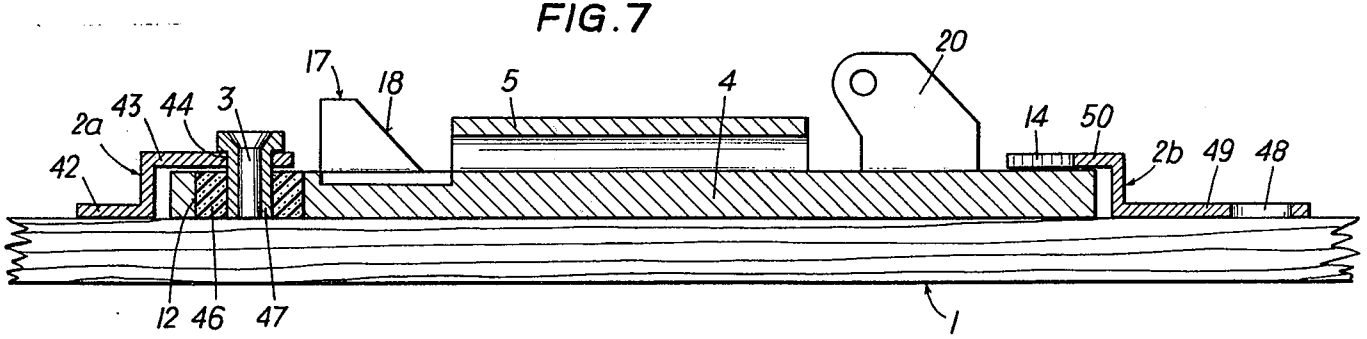
Figure 8:
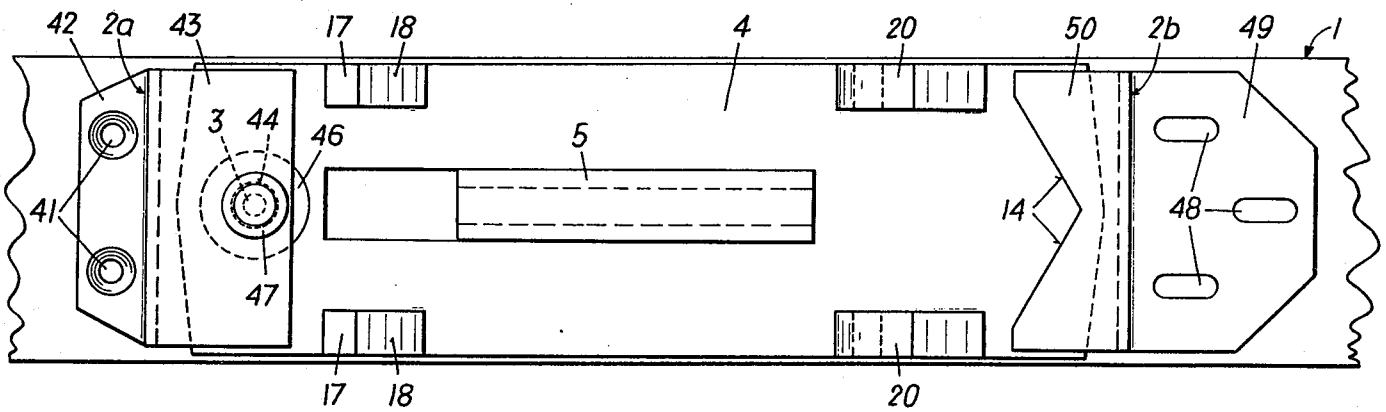

Two embodiments of the ski binding according to the invention are shown by way of example in the drawing, in which FIG. 1 shows a ski binding which is mounted on a ski and a boot which is gripped by the binding, FIG. 2 shows the binding in an open position, FIG. 3 shows the binding when it has been released after a twisting fall, FIG. 4 is a bottom view showing a portion of a skiing boot with a heel designed for use with the ski binding according to the invention, FIG. 5 is an enlarged axial longitudinal sectional view showing the first embodiment of the ski binding according to the invention, FIG. 6 is a sectional view taken on line VI—VI of FIG. 5, FIG. 7 is a view which is similar to FIG. 5 and shows a second embodiment of the ski binding and FIG. 8 is a top plan view showing the ski binding of FIG. 7.

The ski binding according to the invention comprises a baseplate 2, which is adapted to be secured to a ski 1 and carries a pin 3, on which a footplate 4 is rotatably mounted. The longitudinal center line of the footplate 4 extends in the skiing direction. The footplate 4 is provided with a cylindrical or prismatic, hollow rib 5, which extends along the longitudinal center line of the footplate 4 and in which a rod 6 is slidably mounted. At its forward end, which is nearer to the tip of the ski, the rod 6 is connected by a rivet 7 to a block 8. Pins 9 extend transversely to the skiing direction from both sides of the block 8. Rollers 10 are rotatably mounted on the pins 9 on an axis which is parallel to the footplate 4. The baseplate 2 is formed with holes, not shown, which receive screws for fixing the baseplate to the ski. At its forward end, the baseplate 2 terminates in a reversely bent lug 11, which embraces that edge of the footplate 4 which is nearer to the tip of the ski. This lug and the opposite portion of the baseplate 2 hold the pin 3 which extends through a bore 12 of the footplate 4 so that the latter is rotatably mounted on the pin 3. At its end remote from the lug 11, the baseplate 2 is formed with a reversely bent edge portion 13, which overlies the adjacent end of the footplate 4 and which has a longitudinal center line extending in the plane of symmetry that extends at right angles to the surface of the ski and through the axis of the rod. The edge portion 13 has in its longitudinal center line two surfaces 14 which include an angle that is open toward the tip of the ski. These surfaces 14 serve to guide a roller 15, which is rotatably mounted on a pin 16 which depends from the rod 6.

The end faces 25, 26 of the baseplate 2 and the ends of the footplate 4 which are spaced apart in the skiing direction are so shaped and are spaced such distance apart that the footplate 4 can be pivotally moved about the pin 3 as will be described hereinafter.

The footplate 4 is formed at the forward end of each side edge thereof with a ramp 17. Each ramp 17 has rearwardly and downwardly extending rear edge 18. The footplate is formed at each side edge with an upstanding lug 20, which is spaced from the rear end of the ramp 17. An axle 21 extending transversely to the skiing direction is held by said lugs. Side walls 23 of a tightener 22 are symmetrically mounted on said axle 21. A roller 24 is rotatably mounted on the axle 21 between each of the side walls 23 and the adjacent lug 20. The rollers 24 are disposed behind the rollers 10 substantially aligned therewith in the skiing direction.

At a point which is spaced behind the axle 21, the rod 6 is angled to form a rearwardly facing, oblique cam face 27. The rear portion 6A extends parallel to and above the forward portion 6B of the rod. At its end remote from the roller, the rod 6 is provided with external screw threads 28 in threaded engagement with a nut 29.

The tightener lever 22 carries a pin 30, which is mounted in and extends between the side walls 23 of the lever 22 and on which a roller 31 is rotatably mounted. When the tightener 22 is in its stressed position, shown in FIG. 5, the roller 31 engages the lower rod portion 6B at the lower end of the cam face 27. In this position of the tightener the center line of the pin 30 is disposed below the center line of the axle 21. Two links 32 are disposed near opposite ends of the roller 31. Each link is pivoted at one end on the pin 30 and at its other end is pivoted to a slidable sleeve 33, which is freely movably fitted on the upper portion 6A of rod 6. A spring 34 is wound on the rod portion 6A and held under initial stress between the sleeve 33 and the nut 29 so as to bias the tightener 22 in the opening sense, as will be described more fully hereinafter. When the tightener 22 is in its stressed position shown on the drawing, the sleeve 33 suitably engages a hub 35 of the pin 16, which protrudes from the rod 6.

To enable the ski binding described hereinbefore to retain the skiing boot 36 on the ski 1, the heel of the boot is provided with a central longitudinal groove 38, which extends in the skiing direction and serves to receive the rib 5, and the heel is also formed at its ends with concave surfaces 39, 40 which are engageable by the rollers 10, 24.

The ski binding described hereinbefore has the following mode of operation: When the tightener 22 is relaxed, as shown in FIG. 2, the rollers 10 are in a forward position so that their distance from the rollers 24 exceeds the length of the heel 37 of the boot measured along the axis of the groove 38. The skier can now conveniently place the heel on the rib 5 between the rollers 10, 24. When the rib 5 has entered the groove 38 and the skier holds the surface 39 of the heel 37 against the rollers 24, which are immovable in the skiing direction, the tightener 22 is depressed in the direction of arrow A to move from the position shown in FIG. 2 to the position shown in FIG. 1. During this movement of the tightener 22, the toggle joint formed by the tightener and the link 32 is extended so that the links 32 assume the horizontal position shown in FIG. 5 and urge the sleeve 33 to the right so that the spring 34 moves the rod 6 in the same direction.

When the rollers 10 engage the surface 40 of the heel 37 and the pivotal movement of the tightener 22 in the direction of arrow A is continued, the spring 34 is compressed and is thus stressed further until the binding has assumed the position shown in FIGS. 1, 5, and 6.

During a dangerous forward fall, the heel 37 of the boot tends to lift from the ski so that pressure is applied by the surface 40 to the rollers 10, which tend to move the rod 6 toward the tip of the ski. As a result of this displacement of the rod, the cam face 27 lift the roller 31 until the center line of pin 30 is on or above the level of the center line of pin 21 so that the tightener moves from its stable stressed position to an unstable position in which the tightener is already slightly raised and the hub 35 is spaced from the sleeve 33. The spring 34 then causes the tightener 22 to move quickly into the open position shown in FIG. 2.

During this operation, the heel is raised as it rides on the edges 18 of the ramps 17 so that the heel cannot be caught by the rollers 10 as the skier falls.

During a dangerous twisting fall the heel 37 tends to rotate the footplate 4 about the pin 3 in one sense or the other. During this movement the roller 15 runs up on one of the two surfaces 14 and forces the rod 6 in the direction of the arrow B in FIG. 5. In the manner described hereinbefore, the cam face 27 of the rod 6 now raises the roller 31 to open the tightener so that the foot assumes the position shown in FIG. 3. The binding can be restored to its original position by hand or by a rotation of the foot.

When the tightener 22 is opened by hand, the sleeve 33 engaging the hub 35 moves the rod 6 forwardly, toward the tip of the ski, to the position shown in FIG. 2 so that the rollers 10 release the heel 37 and the skier can easily step out of the binding.

The embodiment of the ski binding shown in FIGS. 7 and 8 differs from the one described hereinbefore only in that the baseplate 2 consists of two parts and a shock-absorbing bearing is provided for the pin 3. All other parts of the binding remain the same. For this reason only the footplate 4 and the baseplate which retains the footplate on the ski are shown. The baseplate consists of parts **2*a* and 2*b*. The part 2*a* is substantially Z-shaped in cross-section. The baseplate part 2*a* has a flange 42, which rests on top of the ski and which is formed with bores receiving the fixing screws. The baseplate part 2*a* has another flange 43, which is spaced apart from and parallel to the flange 42 and overlies that end of the footplate which is nearer to the tip of the ski. The flange 43 is formed with a vertical bore 44 in which the pin 3 is mounted. The pin 3 is formed with screw threads, which are screwed into the ski so that the pin 3 serves as an additional fixing screw. The bore 12 in the footplate 4 contains a rubber bushing 46, which is lined with a guide tube 47, in which the pin 3** is rotatably mounted.

The baseplate part **2*b* which overlies that end of the footplate 4 which is more remote from the tip of the ski is formed in its lower flange 49 with three slots 48, which receive the fixing screws, rather than with bores 41 such as are formed in the forward part 2*a* of the baseplate. When these screws have been loosened, the baseplate part 2*b* is adjustable in the skiing direction so that the binding can be adapted to the heel of the boot and the force required for a release is also adjustable. The upper flange 50 is formed with the above-mentioned guiding surfaces 14**, which have the same function as in the first embodiment.

Owing to the rubber bushing 46 the footplate 4 of the ski binding described last can perform a small damped movement mainly in the skiing direction and can thus take up the shocks which are applied to the ski when moving on uneven ground. This ensures a much softer and more convenient movement of the ski than where the conventional shock-absorbing means are employed. In other respects, this embodiment has the same mode of operation as the ski binding described first.

I claim:

1. A ski binding comprising a baseplate adapted to be secured to a ski, a footplate guided by said baseplate, a spring-loaded tightener, and forward and rear rolling means for gripping a heel of a boot, said footplate having mounting means for displaceably mounting a rod, which extends in the skiing direction and is mounted by said mounting means so as to be adjustable in said direction, said rod having a cam face which is oblique in the skiing direction and which cooperates with means carried by said tightener so as to open the same when the ski binding is under an excessively high load in the skiing direction, said footplate being rotatably mounted on a pin which is carried by said baseplate at that end thereof which is nearer to the tip of the ski, said baseplate having guiding surfaces which cooperate during a rotation of said footplate about said pin with means carried by said rod so as to longitudinally displace the same, said forward rolling means being carried by said rod, said rear rolling means being carried by said footplate.

2. A ski binding as set forth in claim 1, characterized in that said forward rolling means comprise rollers, which are disposed on opposite sides of said rod at the forward end thereof and which are rotatable about an axle which extends transversely to the skiing direction, said footplate being provided at its side edges with ramps having edges which rise toward the tip of the ski and are arranged to be engaged by the heel of the skiing boot during a forward displacement of said rollers in response to an excessively high load acting on the ski binding in the skiing direction.

3. A ski binding as set forth in claim 1, characterized in that said baseplate is provided at its rear end with forwardly divergent guiding surfaces, which cooperate with a roller that is mounted on said rod for rotation about a vertical axis.

4. A ski binding as set forth in claim 3, characterized in that said roller which cooperates with said guiding surfaces of said baseplate is mounted on a projection which protrudes downwardly from said rod and a spring is provided, which is wound on said rod and bears on said projection and operates means for opening the ski binding.

5. A ski binding as set forth in claim 1, characterized in that said pin on which said footplate is rotatably mounted is fitted in a rubber bushing.

6. A ski binding as set forth in claim 5, characterized in that said rubber bushing which receives said pin for rotatably mounting the footplate is fitted in a vertical bore of said footplate and is lined with a guide tube.

7. A ski binding as set forth in claim 1, characterized in that said baseplate consists of two parts, which are Z-shaped in longitudinal cross-section, and each of which overlies one end of said footplate so as to permit of a lateral pivotal movement thereof, that part which overlies the rear end of the footplate being formed with slots that extend in the skiing direction and serve to receive fixing screws.

* * * * *